United States Patent [19]

Fox, Sr. et al.

[11] Patent Number: 4,713,852

[45] Date of Patent: Dec. 22, 1987

[54] HYBRID WATER BED MATTRESS

[76] Inventors: Moroni Fox, Sr., 2760 Claybourne Cir., Salt Lake City, Utah 84109; Dana G. Fox, 4467 Nancy Dr., Salt Lake City, Utah 84120

[21] Appl. No.: 842,817

[22] Filed: Mar. 24, 1986

[51] Int. Cl.[4] ..... A47C 27/08

[52] U.S. Cl. ..... 5/451; 5/474; 5/481

[58] Field of Search ..... 5/451, 400, 452, 481, 5/449, 450, 474, 448, 455

[56] References Cited

U.S. PATENT DOCUMENTS

| | | | |
|---|---|---|---|
| 3,833,259 | 9/1974 | Pershing | 5/481 |
| 4,015,299 | 4/1977 | Tinnel | 5/451 |
| 4,186,455 | 2/1980 | Fox et al. | 5/451 |
| 4,187,566 | 2/1980 | Peterson | 5/451 |
| 4,221,013 | 9/1980 | Echevarria | 5/455 |
| 4,577,356 | 3/1986 | Sohenning et al. | 5/451 |

OTHER PUBLICATIONS

"Englander" an Ad by The Englander Co., P.O. Box 927, Pasadena, Calif. 91102–1983.

*Primary Examiner*—Alexander Grosz
*Attorney, Agent, or Firm*—Trask, Britt & Rossa

[57] ABSTRACT

A hybrid water bed mattress construction having a thickness similar to conventional mattresses and having a peripheral restraining foam member to provide a lateral support in all directions and a flexible bladder for holding a body of water is disclosed. Construction generally includes a stacked, two-layer foam restraining member or members having a height of at least as great as the bladder when said bladder is filled with water, typically with the lower foam layer being a tough polyethylene foam material.

9 Claims, 4 Drawing Figures

HYBRID WATER BED MATTRESS

BACKGROUND OF THE INVENTION

1. Field

The instant invention relates to hybrid water bed mattress structures which have a thickness, width and length comparable to conventional innerspring single, double, queen and king size mattresses. Hybrid water bed mattresses are generally supported upon a rigid box-like structure in lieu of a box-spring support and have a weight substantially less than a conventional water bed.

2. Prior Art

In recent years, the bedding industry has developed a hybrid mattress which is a cross between a conventional water bed and a conventional innerspring or foam mattress. These hybrid or composite mattresses have a thin depth, for example, four to eight inches in depth, a water filled bladder and some means of restraining the bladder laterally. Generally, a foam cushion overlay rests upon the bladder to insulate the sleeper's body from the water bladder and to reduce some of the vibrations and waves caused by any motion upon the water-filled bladder.

Typical composite water bed mattresses which have been developed in recent years include the structures disclosed in U.S. Pat. Nos. 4,186,455, Fox et al.; 4,015,299, Tinnel; 3,840,921, LaBainco; 3,702,484, Tobinick; 4,062,077 and 4,145,781, Autrey et al.; 3,742,531, Alsbury; and 3,689,945, Weinstein.

The following patents, although directed to a more conventional water bed structure, disclose structures which are germane to composite water bed mattress structures. Examples of such patents include U.S. Pat. Nos. 3,736,604, Carson; 3,585,356, Hall, and 3,735,432, Kretin.

Other patents disclosing structures relating generally to water beds or structures which may be adapted in certain aspects to composite water beds include the following: U.S Pat. Nos. 3,778,852 (Penn); 3,787,908 (Beck); 3,864,768 (Fraige); 4,042,986 (Goodman); 3,581,322 (Marsico); 2,481,833 (Foster); 3,849,814 (Ross); 3,958,286 (Rodinsky); 3,308,491 (Spence); 1,371,362 (Giese); 3,728,747 (Docker); and 3,864,767 (Adams).

Each of the above-described patents has certain advantages and disadvantages. For example, in Autrey et al, U.S. Pat. No. 4,062,077, the vertical rigid restraining member is adjacent the bladder and must be substantially the same height as the bladder to avoid pinching the bladder against the upper surface of the rigid restraining member. Thus, if the bladder has a substantial thickness, for example four to six inches, the rigid restraining member height must be about the same height, allowing very little foam cushioning above the restraining member's thin edge inasmuch as conventional composite mattresses have a thickness from about six to eight inches. Thus, the restraining member is readily detected and is uncomfortable to sit upon or to lie upon when a bladder of about four inches or more in thickness is used. If thinner bladders are utilized in the Autrey et al. structure, then the flotation effect of the water-filled mattress is substantially diminished.

In the later patent of Autrey et al., a variation of the '077 structure fixes the rigid restraining member to a base.

In the Tinnel structure the restraining wall is a unitary foam construction. It is a flexible foam so it is comfortable to sit on, however, once the bladder is filled there is a tendency of the sidewalls of the structure to bow outwardly because of the hydrostatic pressures involved. Also, since the foam depresses significantly whenever anyone sits upon an edge, the safety reservoir feature is diminished inasmuch as the upper level of the liner is then moved to a position lower than the bladder height. In such an event, water spills out if the bladder has a major leak and water has filled the reservoir.

In Kretin et al. the rigid retaining members have a substantial vertical dimension which brings a thin edge to a position relatively close to the upper foam surface.

In U.S. Pat. No. 4,186,455 of Fox et al. several types of hybrid mattresses are disclosed and claimed. Many of these structures include a horizontal wooden slat in the sidewall of the mattress to provide lateral support. While sidewall structures incorporating a board perform satisfactorily, wooden slats or boards are occasionally characterized by non-uniformity of strength and quality, especially in the inexpensive wooden slats often used in hybrid mattresses. Thus, hybrid mattress sidewall structures which do not employ wooden slats but which resist outward bowing while comfortable to sit upon are desirable.

A hybrid structure without a board is also disclosed in U.S. Pat. No. 4,186,455 of Fox et al. Such multi-layer structures are characterized by a sidewall width which is greater than its height.

LaBianco (U.S. Pat. No. 4,057,862) discloses a peripheral retaining border composed of two wedge-shaped, foam members whose bases are much wider than their heights. A prior patent of LaBianco, U.S. Pat. No. 3,840,921, illustrates a single wedge-shaped peripheral retaining member for a water bed. The LaBianco structures are generally more closely related to conventional water bed structures than to hybrid water bed mattresses of the Tinnel type.

In U.S. Pat. No. 4,506,397 to Fogel et al., a soft-sided water bed is disclosed in which an upper framework has a foam periphery having a notched sidewall to interact with a lower peripheral frame-like member attached to a rigid base. An elongated substantially rigid, angular member is attached to the upper member such that the angular member, similar in structure to angle-iron, fits within the notch and is glued to the upper member to reinforce it.

Other water bed structures having internally slanted foam peripheral members are disclosed in U.S. Pat. Nos. 4,187,566 to Peterson, 4,197,602 to Johanning and 4,187,565 to Zeltzer.

OBJECTS OF THE INVENTION

It is an object of the instant invention to provide a hybrid water bed structure which is easy to fabricate and which provides a comfortable sleeping surface compatible with a peripheral surface which is comfortable to sit upon.

A further object of the instant invention is to provide a hybrid water bed mattress which has external dimensions comparable to conventional inner spring or foam mattresses and which has a durable structure.

It is a further object of the instant invention to provide a hybrid water mattress wherein the lateral thickness of the sidewall is sufficiently thin to optimize the portion of the mattress which comprises a water-filled bladder, consistent with providing good lateral support for the water-filled bladder and a comfortable upper sidewall surface.

SUMMARY OF THE INVENTION

The instant invention relates to hybrid water bed mattresses generally having a thickness of about six to about ten inches. A water bladder for holding a body of water is restrained laterally by a polymeric organic foam restraining border comprising one or more foam layers of the same or different foam types and having a height substantially equal to or greater than the bladder when the bladder is filled with water. A foam cushion is generally superposed over the water bladder and peripheral rigid restraining member. The cushion may be an integral construction or a separate construction with varying thicknesses of foam over the rigid peripheral member and the water-filled bladder.

Figure 1:
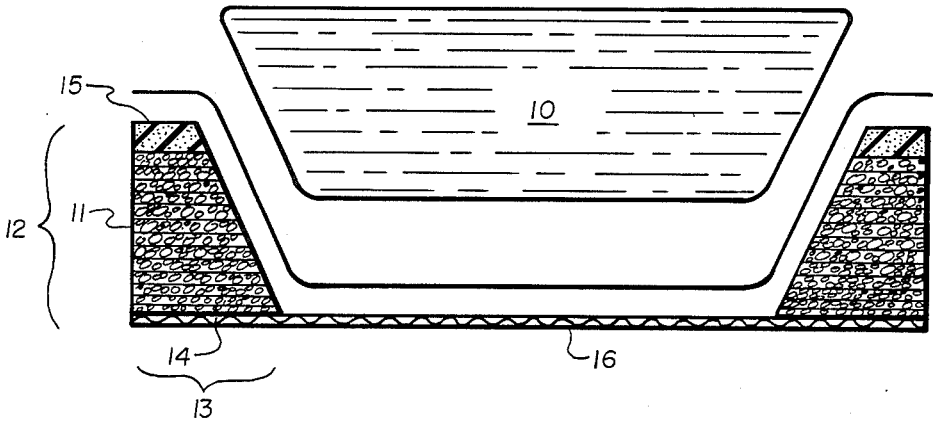
FIG. 1 is a cross-sectional, elevational view of a hybrid mattress construction of the instant invention.
Figure 3:
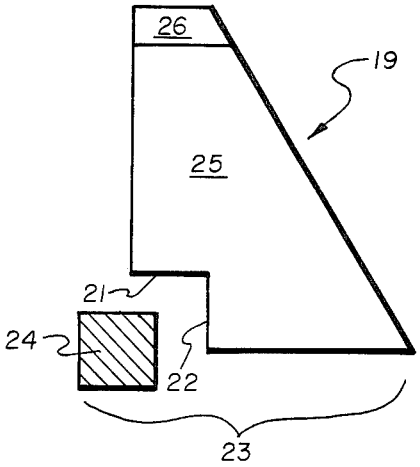
Figure 4:
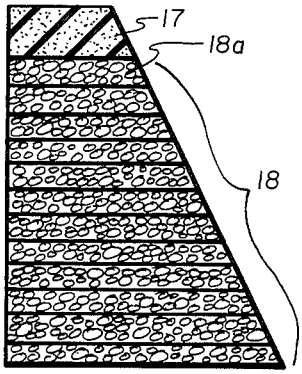

FIG is a cross-sectional, elevational view of a side rail of the type utilized in the construction illustrated in FIG. 1;

FIG. 3 is a cross-sectional elevational view of a notched side rail useful in the instant invention;

FIG. 4 is a cross-sectional elevational view of a side rail useful in the construction illustrated in FIG. 1 wherein a portion of the side rail is formed of thin foam slabs.

DESCRIPTION OF THE ILLUSTRATED EMBODIMENTS

The instant invention relates to a general structure for hybrid water bed mattresses and in particular to a structure which utilizes a a high-strength, low-density polyethylene foam material having a beam strength and resistance to overall beam deflection greater than a polyurethane foam of comparable density and dimensions. Also, the polyethylene foam has outstanding resistance to taking a set from an application of a constant or repeated load.

The particular structure of the invention permits a hybrid water bed mattress to be constructed with a sidewall entirely of polymeric foam material without a solid reinforcing member, such as a wooden board, contained therein which resists sidewall bulging of the mattress when the bladder is filled with water and which resists a permanent depression set caused by persons sitting on the edge of the mattress.

One structure according to the instant invention is illustrated in FIG. 1, which is a cross-sectional view of a hybrid mattress with a foam sidewall 11 having a height 12 greater than the width 13 of its base 14. Generally, the height of the sidewall 11 is about eight inches with the width of base 14 being less than about seven inches while the sidewall top surface 15 has a width of about two inches. It is generally preferred that the top surface 15 have as narrow a width as possible since it is generally desired by a person sleeping on a hybrid mattress to sleep on a water-filled bladder 10, thus the foam portion of the sidewall of the mattress, especially at the top, is preferably very narrow. The bottom surface of one rail or sidewall of the foam mattress may be connected by a mesh material to an opposed sidewall or rail. The mesh 16 is an open fabric structure with a very xinimum elongation when under stress.

Figure 2:
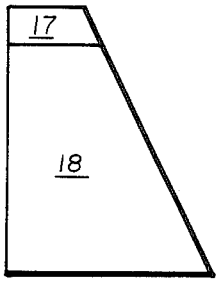

A more detailed illustration of the sidewall of the instant invention is illustrated in FIG. 2. The rail is a composite structure with a top or upper layer 17 made of a low density flexible polyurethane foam having a density of about 1.8 lbs. per cubic feet and an indention load deflection (ILD) value of about 90, although a slightly lower or greater ILD is acceptable. Generally, this upper layer comprises only about one-tenth to about one-half of the total height of the sidewall or rail of the hybrid mattress. In the illustration of FIG. 2, the side rail upper layer is of a height of about one inch with a top surface width of about two inches.

The main structure (lower layer) or sidewall base member 18 is made of a foamed polyethylene material which is tough, substantially resistant to beam deflection and very resistant to compression set. It also has a density of about 1.2 to about 1.7 lbs. per cubic feet with a minimum ILD of 90, although an ILD greater than 90 is typically used. This polyethylene material meets Type 1-Class 3 Federal Specifications No. PPC-C-1752 and No. PPC-C-1752A.

This polyethylene material is a high molecular weight foamed material having an overall strength significantly greater than polyurethane foams having a comparable density and rigidity. For example, a foam mattress constructed according to the teachings of the instant invention utilizing a polyethylene/polyurethane combination side rail according to the structure of FIG. 2 herein shows no perceptible bulge when the bladder of the mattress is filled with water. In contrast, a water mattress made according to the Tinnel invention utilizing a semi-flexible polyurethane foam sidewall generally shows at least a one inch outward bulge in the side rail when the bladder of the mattress is filled with water.

Another structure for a side rail in the instant invention is illustrated in FIG. 3 wherein the rail 19 has a notch in the vertical external sidewall 20, the notch having a horizontal upper surface 21 and a vertical surface 22. The notch runs the entire length of the side rail. Generally, the indentation of vertical surface 22 from vertical wall 20 is less than about one-third the total distance of the extended base 23. For example, in FIG. 3 the extended base dimension is 7½ inches while the horizontal indentation of the notch is two inches. The notch mates with a subrail 24 which is placed upon a foundational support to form a rectangular peripheral member which helps to support the rail 19 and to prevent any lateral displacement of rail 19. Although generally four subrails are joined to form a rectangular border, two opposed subrails may be used to support the longer side rails without any additional support at the foot or head of the mattress. Rail 19 is composed of a polyethylene foam material which forms the lower layer member 25 and a polyurethane foam material which forms the cap or upper layer 26 of the side rail. In this regard, it is similar in structure to the side rail of FIG. 2.

The notched indentation may have relatively small dimensions, for example, the width of the notch is generally less than about two inches horizontally while the vertical height generally is less than about two inches inasmuch as the polyethylene foam material is quite strong and does not require extra support in any direction.

In a similar structure disclosed in U.S. Pat. No. 4,506,397 to Fogel et al., a reinforcing element was required between a notched area of a side rail and the base peripheral supporting frame. Because of the differences between the characteristics of the polyethylene material and the polyurethane materials traditionally used as side rails in hybrid water bed mattresses, no supplementary supporting means is necessary in the polyethylene side rails of the instant invention.

The side rail structure shown in FIG. 3 permits a deeper water bladder to be utilized so that there is a greater depth of water for flotation purposes without requiring the use of larger form-fitting sheets inasmuch as the distance from the top of the side rail to the notched area is generally in the range of about seven to eight inches so that standard fitted sheets may be utilized and that the lower edge of the sheet may be tucked into the corners and along the edge of the upper surface 21 of the notch in the side rail. Again, because of the strength and toughness of the polyethylene foam material used in the side rail, there is no significant likelihood of shearing or tearing the polyethylene foam side rail when the corner or sides of the side rail are lifted slightly for the purpose of inserting a sheet between subrail 24 and the notch in the polyethylene foam side rail.

In FIG. 4, a vertical cross-section of a side rail structure is illustrated. The overall height of the structure is generally in the vicinity of about seven to eight inches, and the width at the base is usually about four to eight inches. The width of the upper surface is about two to four inches. The side rail is composed of two members, a lower base foam member made of a polyethylene foam and an upper foam member made of a polyurethane flexible foam. The polyurethane foam layer is bonded by an adhesive to the polyethylene base member.

The polyethylene foam base member may be from about three to about seven inches in height with the polyurethane foam layer being about one inch to about four inches in height. Generally, it is preferred that the overall height, that is, the combined heights of the lower and upper members be at least about seven inches.

The polyethylene foam base member provides most of the structural support of the side rail. The polyethylene foam base member is a tough, substantially rigid, although with significant resilience, polyethylene foam having substantial resistance to beam deflection and a substantial resistance to compression set. It has a density of about 1.2 to about 2.5, especially from about 1.2 to about 2.0, and preferably from about 1.2 to about 1.7 lbs. per cubic foot. The polyethylene foam has a large cell structure with the smallest cells of the polyethylene foam having a diameter of about 1/32 of an inch while cell sizes of about ⅛ inch and larger are common. In contrast, a polyurethane foam of similar density has cells which are all significantly smaller than 1/32 inch.

The polyethylene foam base member is a laminate of thin slabs 18*a* of polyethylene foam. The individual slabs have a rectangular base and top surface and thickness of about ½ to about one inch. The polyethylene foam is made in molds via a heating process such that lightweight foams are attainable more readily in thin sections. Each slab of polyethylene foam is bonded to the other to form a tough, integral structure. While the polyethylene foam is a substantially rigid foam, it is much tougher, for example, than a polystyrene foam of a similar density and rigidity.

The polyethylene foam is tough to tear and, upon indentation, the cell walls do not break but stretch sufficiently to adapt to the indentation and then gradually rebound to an original position. For example, pressing one's thumb with some force into the surface of the polyethylene foam will leave a thumb indentation for a short period of time, but the indentation will ultimately be recovered fully, while pressing a typical polystyrene foam with the thumb with the same pressure will cause cell walls to break and will leave a substantial permanent indentation in the polystyrene foam.

The polyethylene foam is a closed cell foam and resists taking a set or permanent deformation under load. For example, a load of 5 lbs. per square inch over a period in excess of 500 hours is required to cause the polyethylene foam to take a set.

The resistance of the polyethylene foam to taking a permanent set is a very desirable property for a hybrid water bed mattress side rail material inasmuch as it is common for the edges of hybrid water bed mattresses, the same as any mattress, to be sat upon. If the side rail material readily takes a set, then after awhile there is a depression made by constant sitting upon the side rail. Such a permanent depression detracts from the appearance of the bed and also, if the depression becomes great enough, undermines the purpose of the safety liner concept forming a well formed by the sidewalls of the side rail and the vinyl liner to act as a safety reservoir should a bladder spring a leak.

Generally, side rails of the instant invention are preferred in which the cross-sectional area of each side rail contains at least 12 square inches of polyethylene foam of appropriate density. A cross-sectional area of at least 16 inches is more desirable and preferably, a cross-sectional area of about 20 inches is preferred.

Although the side rail structure in cross-sections is illustrated as having a sloped sidewall facing the water bladder, it is understood that the side rail construction may be square or rectangular in cross-section with the longer leg of a rectangular cross-section being vertical. Generally, the rail will have a base width of at least about four inches with widths of about five to six inches being preferred.

We claim:

1. A hybrid water bed mattress having dimensions substantially similar to those of a conventional innerspring mattress comprising:

a water-filled bladder; and a peripheral restraining member for providing lateral support for said bladder when it is filled with water, said restraining member comprising:

an encircling sidewall having an overall height substantially equivalent to the height of said bladder when filled with water and a width sufficient to resist, without substantial deflection of said sidewall, the lateral force applied to said sidewall by a water-filled baldder, said sidewall containing as at least a significant part of its lateral support structure a tough, resilient, substantially rigid polyethylene foam having a density of about 1.2 lbs. per cubic foot to about 2.0 lbs. per cubic foot, said polyethylene foam having at least two internal laminations of polyethylene foam slabs of substantially identical physical and chemical properties bonded together, the bonds between said slabs being substantially planar and substantially parallel to the lateral force applied to said sidewall by a water-filled bladder, said polyethylene foam having a significant resistance to take a deformation set upon exposure to significant loads over an extended period of time.

2. An improved box-like side rail structure for externally supporting a hybrid water bed mattress comprising: four elongated beam-like members joined at the ends to one another to form a box-like frame, said beam-like members being constructed of a substantially rigid lightweight polyethylene foam having a density of about 1.2 to about 2.0 lbs. per cubic foot, said polyethylene foam being formed of at least four individual slabs of such foam, having substantially identical physical and chemical properties and being bonded together to form an integral load bearing structure and wherein the slabs of polyethylene foam are oriented so that the surfaces bonded together lie substantially in planes substantially parallel to the base of said side rail.

3. The side rail structure of claim 2 wherein the average lateral thickness of a said polyethylene foam slab beam-like member is at least about three inches.

4. The side rail structure of claim 2 wherein a said polyethylene foam beam-like member in a vertical-lateral cross section is a four-sided structure wherein the base dimension is at least as great as the top dimension.

5. The side rail structure of claim 2 wherein a said polyethylene foam beam-like member is a laminate of slabs of polyethylene foam less than about one inch in height, bonded together.

6. The side rail structure of claim 2 wherein the uppermost polyethylene foam slab has bonded to its upper surface an upper foam layer of more flexible, softer foam material.

7. The side rail structure of claim 6 wherein said upper foam layer is a flexible polyurethane foam having an ILD substantially less than said polyethylene foam.

8. The side rail structure of claim 6 wherein said uppermost polyethylene slab forms a load bearing base member and said upper foam layer provides a cushioning effect.

9. A hydrid water bed mattress having dimensions, i.e., width, length and thickness substantially similar to that of a conventional inner spring mattress, comprising:

a water-fillable bladder; and a peripheral restraining member for providing lateral support in all directions for said bladder when filled with water, said restraining member comprising:

an encircling sidewall having an overall height greater than its width, said sidewall comprising at least two superposed foam member, a lower foam member and an upper foam member secured to said lower foam member, said foam members forming an integral sidewall wherein the base of said sidewall, in a vertical-lateral cross-section, is wider than its top surface, its inner surface facing said bladder is substantially planar, rectangular and at an acute angle with respect to said base, its outer surface is essentially planar, rectangular and substantially perpendicular to said base; said lower foam member having a substantial resistance to beam deflection and being substantially more rigid than said upper foam member and having a height substantially greater than said upper member and a density of about 1.5 to about 2.0 lbs. per cubic foot; said upper foam member having a base which is substantially coextensive with the top surface of the lower foam member, the upper member being fixed to said lower member; said lower foam member having an ILD of about 70 to about 110 and being formed of a plurality of polyethylene foam slabs of substantially identical physical and chemical properties, bonded together.

* * * * *